US008108121B2

(12) United States Patent
Mai et al.

(10) Patent No.: US 8,108,121 B2
(45) Date of Patent: Jan. 31, 2012

(54) METHOD AND DEVICE FOR CORRECTING THE FUEL CONCENTRATION IN THE REGENERATION GAS FLOW OF A TANK VENTING DEVICE

(75) Inventors: Wolfgang Mai, Eschborn (DE); Jens Pache, Kaufungen (DE)

(73) Assignee: Continental Automotive GmbH, Hannover (DE)

( * ) Notice: Subject to any disclaimer, the term of this patent is extended or adjusted under 35 U.S.C. 154(b) by 797 days.

(21) Appl. No.: 12/237,691

(22) Filed: Sep. 25, 2008

(65) Prior Publication Data

US 2009/0084084 A1 Apr. 2, 2009

(30) Foreign Application Priority Data

Sep. 28, 2007 (DE) ..... 10 2007 046 482

(51) Int. Cl.
*F02M 25/08* (2006.01)
*F02M 37/04* (2006.01)
*F02D 41/30* (2006.01)

(52) U.S. Cl. ..... 701/103; 123/520

(58) Field of Classification Search ..... 701/103–105; 123/520, 521, 516, 518, 519
See application file for complete search history.

(56) References Cited

U.S. PATENT DOCUMENTS 6,247,458 B1 * 6/2001 Heinemann et al. ..... 123/520
6,523,532 B1 2/2003 Esteghlal et al. ..... 123/698
2010/0031932 A1 * 2/2010 Mai et al. ..... 701/104

FOREIGN PATENT DOCUMENTS

DE 19936166 7/1999

* cited by examiner

*Primary Examiner* — Hieu T Vo
(74) *Attorney, Agent, or Firm* — King & Spalding L.L.P.

(57) ABSTRACT

In a method for correcting the fuel concentration in a regeneration gas flow of a tank venting device, the fuel concentration is determined, and a defined regeneration gas flow rate is set and supplied to the engine to use the regeneration gas in the combustion process. Then, a reference composition is determined and the flow rate is varied. Then, a first injection amount correction value is determined based on the fuel concentration and the flow rate adjustment amount. A prespecified quantity of fuel is corrected by the first correction value and the exhaust gas composition is determined again after the corrected fuel quantity has been supplied. A second correction value is determined by which the corrected fuel quantity is further corrected to set the exhaust gas composition to the reference composition. The fuel concentration of the regeneration gas flow is corrected by the first and the second correction values.

12 Claims, 4 Drawing Sheets

METHOD AND DEVICE FOR CORRECTING THE FUEL CONCENTRATION IN THE REGENERATION GAS FLOW OF A TANK VENTING DEVICE

CROSS-REFERENCE TO RELATED APPLICATIONS

This application claims priority to German Patent Application No. 10 2007 046 482.9 filed Sep. 28, 2007, the contents of which is incorporated herein by reference in its entirety.

TECHNICAL FIELD

The invention relates to a method and a device for correcting the value of the fuel concentration in a regeneration gas flow of a tank venting device for an internal combustion engine.

BACKGROUND

In order to comply with the legal emission limits, modern motor vehicles with a petrol engine have a tank venting device by means of which fuel vapors escaping from the fuel tank are collected and stored in a suitable storage tank (generally an activated carbon canister). From time to time, it is necessary to regenerate the storage container. To this end, the storage container is connected to an inlet manifold of the internal combustion engine by means of a venting pipe. The controlled opening of a tank venting valve located in the venting pipe pneumatically connects the storage container with the inlet manifold. Due to the negative pressure prevailing in the inlet manifold, the fuel vapors stored in the storage container are sucked into the inlet manifold and then participate in the combustion process.

The combustible mixture changes depending on the concentration of the hydrocarbons in this regeneration gas flow. It is however necessary to set the air/fuel ratio of the combustible mixture to a defined value in order to ensure a sufficient combustion quality (running smoothness) and optimum exhaust gas treatment. Without further measures, the introduction of the regeneration gas into the inlet manifold would result in a deterioration of the exhaust gas quality or impairment of the combustion stability. In order to prevent this, the quantity of fuel supplied to the internal combustion engine by means of an injection valve is adapted to the quantity of fuel that is additionally supplied by the regeneration gas flow. For this, however, the fuel concentration in the regeneration gas flow must be known as precisely as possible.

According to a known method, the fuel concentration in the regeneration gas flow can be determined by measuring the exhaust gas composition with a lambda sensor when the tank venting valve is closed and storing this as a reference variable. The tank venting valve is then gradually opened and the change that this causes in the exhaust gas composition is determined. Based on the difference in the exhaust gas composition, the fuel concentration in the regeneration gas flow can be determined. If it is determined during an executed tank venting process that the value for the fuel concentration in the regeneration gas flow has been incorrectly ascertained or has changed, the tank venting valve must be closed, a constant operating point of the internal combustion engine waited for and the fuel concentration in the regeneration gas flow determined once again. This very time-consuming process considerably restricts the number of possible tank venting processes and the flexibility of their execution.

SUMMARY

A method and a device can be provided by means of which the flexibility in the execution of the tank venting processes and their frequency can be increased.

According to an embodiment, a method for correcting the fuel concentration in a regeneration gas flow which is conducted from a fuel vapor canister of a tank venting device for an internal combustion engine, may comprise the steps of:—determining the fuel concentration in the regeneration gas flow,—setting a defined regeneration gas flow rate and supplying the gas flow rate to the internal combustion engine such that the regeneration gas is used in the combustion,—determining a reference composition of the exhaust gas of the internal combustion engine,—varying the regeneration gas flow rate by a pre-specified adjustment amount,—determining a first injection quantity correction value based on the fuel concentration in the regeneration gas flow and the adjustment amount of the regeneration gas flow rate,—correcting a pre-specified fuel quantity, that is to be supplied to the internal combustion engine by at least one injection valve, by the first injection quantity correction value,—re-determining the exhaust composition following the supply of the corrected fuel quantity,—determining a second injection quantity correction value by which the corrected fuel quantity supplied by the at least one injection valve is to be further corrected in order to adjust the exhaust gas composition to the reference composition, and—correcting the fuel concentration of the regeneration gas flow based on the first and the second injection quantity correction values. According to another embodiment, a control device for an internal combustion engine, which in order to correct the fuel concentration in a regeneration gas flow that is conducted out of a fuel vapor canister of a tank venting device for the internal combustion engine during a tank venting period, may be operable to:—determine the fuel concentration in the regeneration gas flow,—set a defined regeneration gas flow rate and to supply the gas flow rate to the internal combustion engine such that the regeneration gas is used in the combustion,—determine a first reference composition of the exhaust gas of the internal combustion engine,—vary the regeneration gas flow rate by a pre-specified adjustment amount,—determine a first injection quantity correction value based on the fuel concentration in the regeneration gas flow and the adjustment amount of the regeneration gas flow rate,—correct a pre-specified fuel quantity, that is to be supplied to the internal combustion engine by at least one injection valve, by the first injection quantity correction value,—re-determine the exhaust composition following the supply of the corrected fuel quantity,—determine a second injection quantity correction value by which the corrected fuel quantity supplied by the at least one injection valve is to be further corrected in order to adjust the exhaust gas composition to the reference composition, and—to correct the fuel concentration of the regeneration gas flow based on the first and the second injection quantity correction values.

According to a further embodiment, an estimated value can be formed based on variables that influence the charge state of the fuel vapor canister with fuel vapor in order to determine the fuel concentration in the regeneration gas flow. According to a further embodiment, the internal combustion engine can be operated at a constant operating point from the time when the first reference composition is determined until at least the time when the exhaust gas composition of the internal combustion engine is determined again in order for the steps of the method to be carried out. According to a further embodiment, in the event that the exhaust gas composition is within a pre-specified tolerance range around the reference exhaust gas composition after the corrected fuel quantity has been supplied, the value of the fuel concentration in the regeneration gas flow can be judged to be plausible and no correction is carried out.

BRIEF DESCRIPTION OF THE DRAWINGS

The invention is explained in more detail below with reference to an exemplary embodiment and with reference to the attached figures, in which.

DETAILED DESCRIPTION

Figure 1:
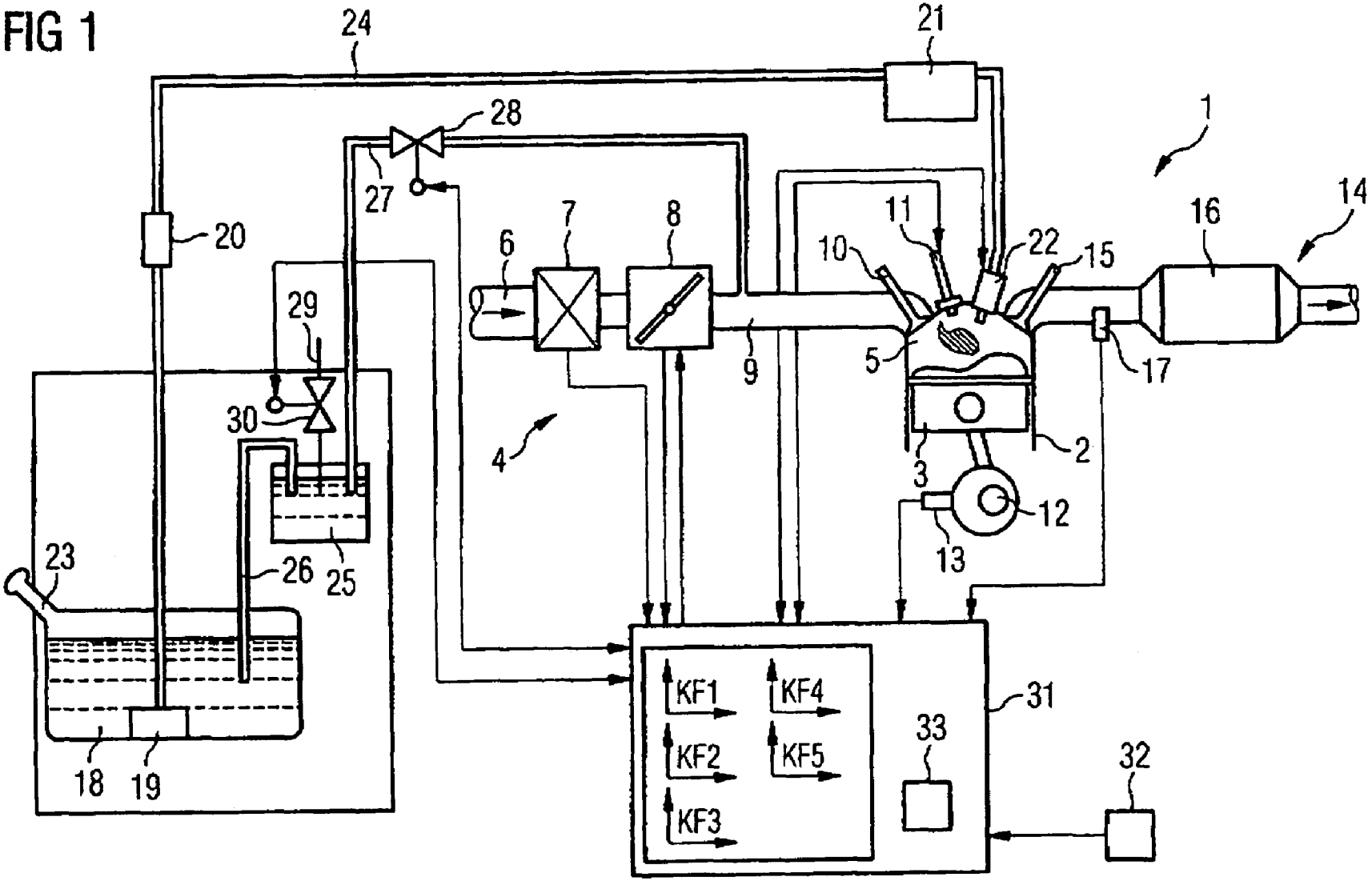
FIG. 1 shows a schematic representation of an internal combustion engine.

In the method for correcting the fuel concentration in a regeneration gas flow of a tank venting device for an internal combustion engine according to an embodiment, the fuel concentration in the regeneration gas flow is first determined. Then, a defined regeneration gas flow rate is set and supplied to the internal combustion engine in such a way that the regeneration gas participates in the combustion process. Then, a reference composition of the exhaust gas of the internal combustion engine is determined and the regeneration gas flow rate varied by a preset adjustment amount. A first injection quantity correction value is determined based on the fuel concentration in the regeneration gas flow and the adjustment amount of the regeneration gas flow rate, and a preset fuel quantity that is to be supplied to the internal combustion engine by means of at least one injection valve is corrected by the first injection quantity correction value. After the corrected fuel quantity has been supplied, the exhaust gas composition is determined again. A second injection quantity correction value is determined by which the corrected fuel quantity that has been supplied by at least one injection valve is to be further corrected in order to adjust the exhaust gas composition again to the first reference composition. The fuel concentration of the regeneration gas flow is then corrected based on the first and the second injection quantity correction values.

The method offers the opportunity to detect an incorrect value for the fuel concentration in the regeneration gas flow and to correct it within a short time, even if the tank venting valve is open. This allows a correction to the fuel concentration in the regeneration gas flow to be carried out within a short time even during a tank venting process. It is not necessary to close the tank venting valve. This considerably increases the flexibility and the frequency of the tank venting processes. Due to the short amount of time required for the method, the value for the fuel concentration in the regeneration gas flow can be corrected at frequent intervals. This ensures a more precise injection amount correction for the tank venting process, which has a positive effect on the combustion stability and the exhaust gas quality.

In an embodiment of the method, an estimated value is established based on variables that influence the charging of the fuel vapor canister with fuel vapors in order to determine the fuel concentration in the regeneration gas flow.

According to this embodiment, the fuel concentration is estimated according to the variables that affect the charge state of the fuel vapor canister. The relevant variables include for example the service life of the vehicle, the ambient temperature, the fill level of the fuel in the fuel tank and the ambient pressure. A certain imprecision in the estimate of the fuel concentration can be accepted, as the value for the fuel concentration can be corrected within a short time and with a high degree of accuracy according to various embodiments. The estimated value for the fuel concentration can be determined once after each time the internal combustion engine is started. For subsequent tank venting processes, the corrected value for the fuel concentration can be used.

In an embodiment of the method, the internal combustion engine is operated at a constant operating point from the time when the first reference composition is determined until at least the time when the exhaust gas composition is determined again in order for the method steps to be executed.

This procedure allows the precision of the determination of the fuel concentration in the regeneration gas flow to be considerably increased. This means that a distortion of the value for the fuel concentration in the regeneration gas flow due to an overlap with other effects that occur when the operating point changes and that affect the combustible mixture can be largely eliminated. Examples of an effect of this type could be nonlinearities in the characteristic curve of the injection valve due to the operating point, or age-related alterations in the operating behavior of certain components of the injection system. An overlapping of the injection quantity correction that can be attributed exclusively to the tank venting process with an injection quantity correction that can be attributed to other effects results in an incorrect calculation of the fuel concentration in the regeneration gas flow, which can cause impaired combustion behavior and a poorer exhaust gas composition.

In a further embodiment of the method, the value for the fuel concentration in the regeneration gas flow is judged to be plausible and no correction is performed if the exhaust gas composition lies within a pre-specified tolerance range around the first reference gas composition following the metering of the corrected fuel quantity.

This embodiment of the method offers a simple opportunity for checking the plausibility of the value of the fuel concentration. A correction of the value of the fuel concentration in the regeneration gas flow is only made in the event of a significant deviation.

A control device for an internal combustion engine according to another embodiment is designed in such a way that it can execute the steps of the above described method in order to correct the fuel concentration in a regeneration gas flow of a tank venting device of an internal combustion engine.

Certain advantages that result from a control device of this type will be referred to below.

FIG. 1 shows an exemplary embodiment of an internal combustion engine 1. The internal combustion engine 1 has at least one cylinder 2 and a piston 3 that moves up and down in the cylinder 2. The fresh air required for the combustion is introduced via an inlet tract 4 into a combustion chamber 5 delimited by the cylinder 2 and the piston 3. Downstream of an inlet port 6, the inlet tract 4 contains an air-flow sensor 7 for detecting the air flow rate in the inlet tract 4, which can be considered as a measurement of the load on the internal combustion engine 1, a throttle valve 8 for controlling the air flow rate, an inlet manifold 9 and an inlet valve 10 by means of which the combustion chamber 5 is selectively connected to or separated from the inlet tract 4.

The combustible mixture is ignited by means of a spark plug 11. The drive energy generated by the combustion is transferred by means of a crankshaft 12 to the drive train of the motor vehicle (not shown). An rpm sensor 13 detects the speed of the internal combustion engine 1.

The combustion exhaust gases are conducted out of the internal combustion engine 1 via an exhaust tract 14. The combustion chamber 5 is selectively connected to or separated from the exhaust tract 14 by means of an outlet valve 15. The exhaust gases are cleaned in an exhaust gas treatment catalytic converter 16. In the exhaust tract 14, there is also a lambda sensor 17 for measuring the oxygen content in the exhaust gas. The lambda sensor 17 may either be a binary lambda sensor or a linear lambda sensor 17.

The internal combustion engine 1 also comprises a fuel supply device with a fuel tank 18, a fuel pump 19, a high-pressure pump 20, an accumulator 21 and at least one controllable injection valve 22. The fuel tank 18 has a sealable filler neck 23 through which the fuel is added. The fuel is supplied to the injection valve 22 through a fuel supply line 24 by means of the fuel pump 19. The high-pressure pump 20 and the accumulator 21 are arranged in the fuel supply line 24. The high-pressure pump 20 has the task of supplying the fuel to the accumulator 21 at high pressure. The accumulator 21 is arranged here as a common accumulator for all injection valves 22. All the injection valves 22 are supplied with pressurized fuel from here. In the exemplary embodiment, the internal combustion engine 1 has direct fuel injection, whereby the fuel is injected directly into the combustion chamber 5 by means of an injection valve 22 that protrudes into the combustion chamber 5. It is to be noted, however, that the various embodiments are not restricted to this type of fuel injection, but can also be applied to other types of fuel injection, such as inlet-manifold fuel injection.

Furthermore, the internal combustion engine 1 has a tank venting device. The tank venting device comprises a fuel vapor canister 25, which is designed as an activated carbon canister for example, and which is connected to the fuel tank 18 by means of a connecting line 26. The fuel vapor that is produced in the fuel tank 18 is conducted into the fuel vapor canister 25 where it is absorbed by the activated carbon. The fuel vapor canister 25 is connected to the inlet manifold 9 of the internal combustion engine 1 by means of a venting line 27. A controllable tank venting valve 28 is located in the venting line 27. Furthermore, fresh air can be supplied to the fuel vapor canister 25 via a ventilation line 29 and a controllable ventilation valve 30 that is optionally located therein. In certain operating ranges of the internal combustion engine 1, in particular when idling or under partial load, there is a large difference in pressure between the environment and the inlet manifold 9 due to the strong throttling effect of the throttle valve 8. The opening of the tank venting valve and the ventilation valve 30 during a tank venting period therefore generates a purging effect in which the fuel vapor stored in the fuel vapor canister 25 is conducted into the inlet manifold 9 as a regeneration gas flow and is used in the combustion process. The fuel vapor thus causes an alteration in the composition of the combustion gases and the exhaust gases.

The internal combustion engine 1 is allocated a control device 31 in which engine control functions based on characteristic maps (KF1 to KF5) are implemented as software. The control device 31 is connected to all actuators and sensors of the internal combustion engine 1 via signal and data lines. In particular, the control device 31 is connected to the controllable ventilation valve 30, the controllable tank venting valve 28, the air-flow sensor 7, the controllable throttle valve 8, the controllable injection valve 22, the spark plug 11, the lambda sensor 17, the rpm sensor 13 and an integrated pressure/temperature sensor 32 for measuring the ambient temperature and the ambient pressure.

Parts of the internal combustion engine 1 and the control device 31 form a lambda controller device. The lambda controller device comprises in particular the lambda sensor 17, a lambda controller 33 implemented as software in the control device 31, and the injection valves 22 and their control mechanism and control electronics with which the quantity of fuel dosed by the injection valves 22 is controlled. The lambda controller device forms a closed lambda control circuit and is configured in such a way that a deviation of the exhaust gas composition from a pre-specified lambda nominal value detected by the lambda sensor 17 is corrected by means of an injection quantity correction. If the tank venting valve 28 is opened during the tank venting period, the drop in pressure causes the fuel vapor to flow from the fuel vapor canister 25 into the inlet tract 4 and the inlet manifold 9 of the internal combustion engine 1. Depending on the concentration of the fuel vapor in this regeneration gas flow, this results in an alteration in the combustible mixture and the exhaust gas composition. The lambda value measured by the lambda sensor 17 differs from a current nominal value. There is therefore a deviation from the norm, which is registered by the lambda controller 33 and which is compensated for by an appropriate adjustment in the controller output variable. This is brought about by specification of an appropriate correction variable to the injection valve 22, which causes the injected fuel quantity to be corrected in line with an injection quantity correction value until the fault is compensated for. This process will be described below as the injection quantity correction. In order for the injection quantity correction to be performed, the fuel concentration in the regeneration gas flow must be determined as accurately as possible.

Figure 2:
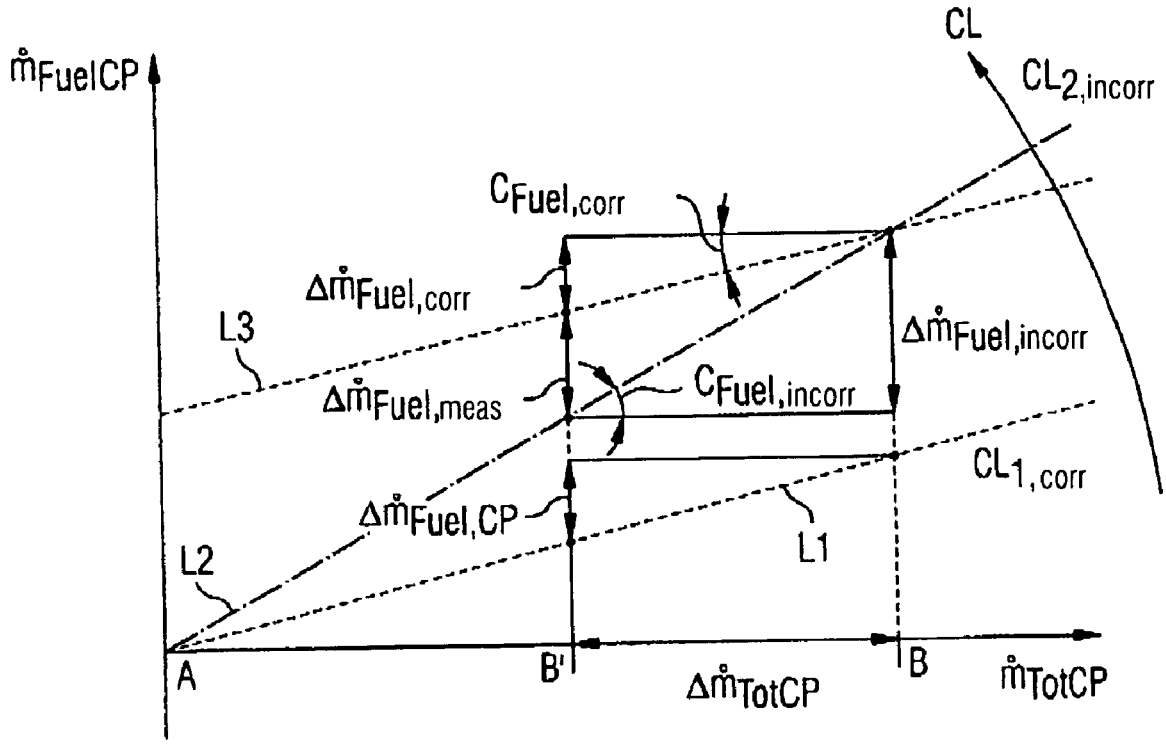
FIG. 2 shows a diagram in which the fuel flow rate in the regeneration gas flow is represented as a proportion of the total regeneration gas flow rate.

FIG. 2 shows the fuel flow rate $m_{Fuel,CP}$ contained in the regeneration gas flow as a proportion of the total regeneration gas flow rate $m_{Tot,CP}$. As can be seen from the dashed line L1, there is an essentially linear correlation between these two variables. In general, the fuel concentration in the regeneration gas flow corresponds to the gradient of the lines in FIG. 2 and can be calculated as follows:

$$C_{Fuel,CP} = \frac{\Delta m_{Fuel,CP}}{\Delta m_{Tot,CP}} \quad \text{(Equation 1)}$$

In the following, it is assumed that the line L1 expresses the actual, correct correlation between the fuel flow rate $m_{Fuel,CP}$ in the regeneration gas and the total regeneration gas flow rate $m_{Tot,CP}$. This means that the gradient of line L1 corresponds to the actual, correct fuel concentration $C_{Fuel,CP}$ in the regeneration gas.

If the fuel concentration in the regeneration gas is incorrectly calculated, the correlation depicted by the dot-dashed line L2 results. If the tank venting valve 28 is controlled in such as way that the total regeneration gas flow rate $m_{Tot,CP}$ is reduced from a value B to a value B', this results in an alteration $\Delta m_{Fuel,incorr}$ of the fuel flow rate in the regeneration gas in accordance with line L2. From this, an incorrect fuel concentration $C_{Fuel,incorr}$ can be calculated according to equation 1.

However, the actual behavior is reflected by line L3, which runs parallel to line L1. According to this, a change in the total regeneration gas flow rate $m_{Tot,CP}$ from B to B' results in a change $\Delta m_{Fuel,corr}$ of the fuel flow rate in the regeneration gas. From this, the correct fuel concentration $C_{Fuel,corr}$ can be calculated according to equation 1.

Due to the deviation between the values $C_{Fuel,incorr}$ and $C_{Fuel,corr}$ of the fuel concentration in the regeneration gas, an injection quantity correction based on the incorrect correlation L2 results in an incorrect injection quantity correction and an enduring deviation of the exhaust gas composition from the initial value that was determined before the alteration of the regeneration gas flow. This is recorded by the lambda sensor. The lambda controller then corrects the injection quantity flow supplied by the injection valves by the injection quantity correction value $\Delta m_{Fuel,meas}$ in order to adjust the exhaust gas composition back to the initial value. As is clear from FIG. 2, the following correlation thus exists:

$$\Delta m_{Fuel,corr}=\Delta m_{Fuel,incorr}-\Delta m_{Fuel,meas} \quad \text{(Equation 2)}$$

The injection quantity correction value $\Delta m_{Fuel,meas}$ calculated by the lambda controller that results from the deviation of the exhaust gas composition from the nominal value can be calculated according to the following formula:

$$\Delta m_{Fuel,meas} = \frac{m_{Air,cyl}}{k_S \times \lambda_{SP}}\left(\frac{\lambda_{SP}}{\lambda_{meas}} - [1 + \Delta LC]\right) \quad \text{(Equation 3)}$$

where $m_{Air,cyl}$ is the fresh air flow rate measured by the airflow sensor 7, $k_S$ is the stoichiometric constant for air, $\lambda_{SP}$ is the nominal value for the exhaust gas composition (lambda value), $\lambda_{meas}$ is the actual lambda value measured by the lambda sensor 17 and ΔLC is the deviation of the measured lambda value $\lambda_{meas}$ from the nominal value $\lambda_{SP}$.

If the incorrect fuel concentration $C_{Fuel,incorr}$ is known, the correct value $\Delta m_{Fuel,corr}$ for the injection quantity correction that results from the application of the correlation according to line L3 can be calculated by combining the equations 1 to 3 into the following equation:

$$\Delta m_{Fuel,corr} = \Delta m_{Tot,CP} \times C_{Fuel,incorr} - \frac{m_{Air,cyl}}{k_S \times \lambda_{SP} \times m_{Tot,CP}}\left(\frac{\lambda_{SP}}{\lambda_{meas}} - [1 + \Delta LC]\right) \quad \text{(Equation 4)}$$

The correct fuel concentration in the regeneration gas flow can then be calculated by applying equation 1:

$$C_{Fuel,corr} = \frac{\Delta m_{Fuel,corr}}{\Delta m_{Tot,CP}} \quad \text{(Equation 5)}$$

Figure 3A:
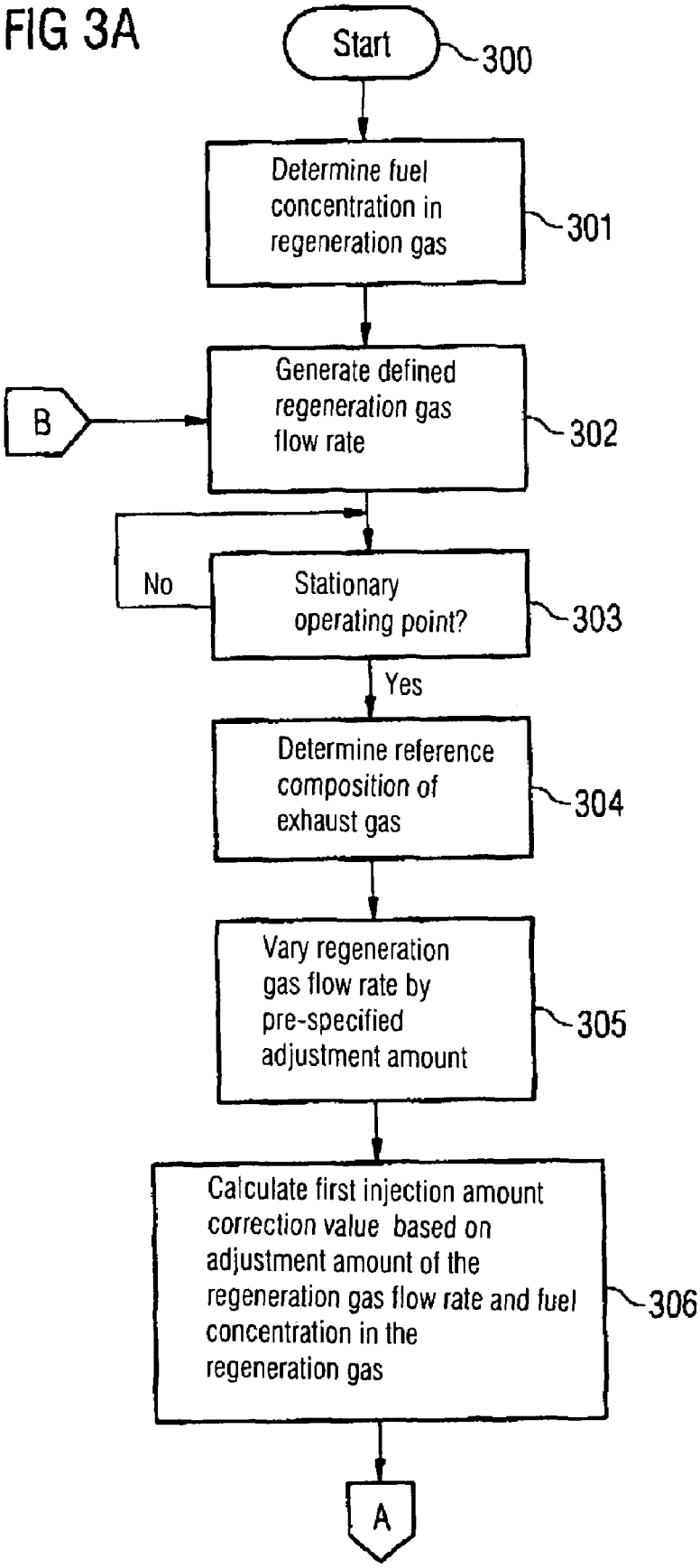
FIG. 3 shows an exemplary embodiment of a method for correcting the fuel concentration in a regeneration gas flow in the form of a flow diagram.
Figure 3B:
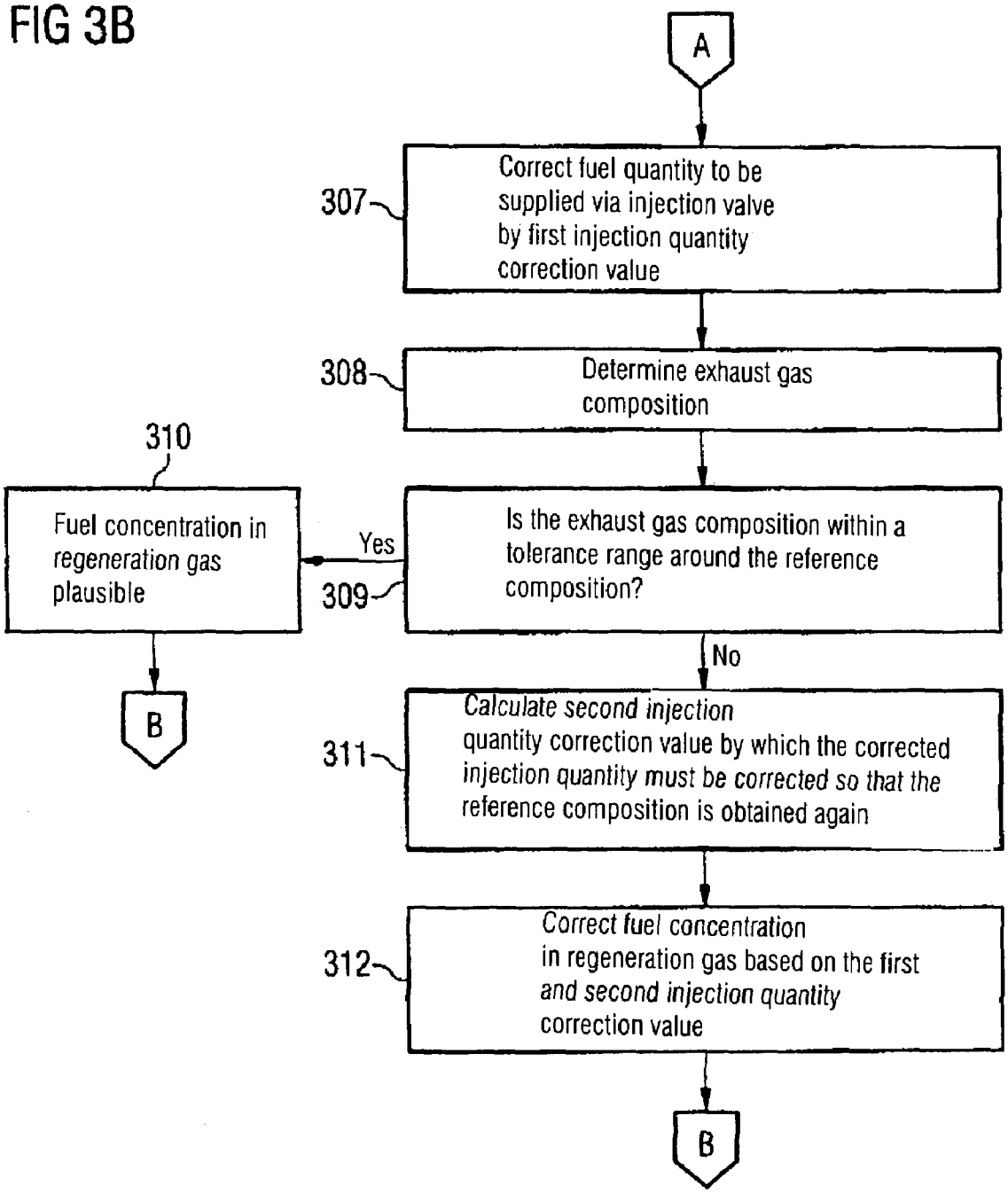

An exemplary embodiment of a method for correcting the fuel concentration in the regeneration gas flow of a tank venting device for an internal combustion engine will now be explained in more detail with reference to the flow diagram in FIG. 3.

The method is started in step 300, for example when the internal combustion engine 1 is started. In step 301, the fuel concentration in the regeneration gas is determined. This may be brought about with the estimation of a value for the fuel concentration in the regeneration gas flow based on variables that influence the fuel concentration. These variables include for example the ambient temperature, the ambient pressure, the fill level of the fuel tank and the time since the last tank venting process. The variables can be measured by appropriate sensors. An estimated value can be determined using characteristic maps populated with appropriate data.

Alternatively, the fuel concentration in the regeneration gas can also be determined according to the method known from the prior art. For this, the tank venting valve is slowly opened from a completely closed state so that a small regeneration gas flow is introduced into the inlet manifold of the internal combustion engine and used in the combustion. The changing combustion mixture composition caused by this is detected by the lambda sensor 17. The lambda controller 33 can use this to calculate the quantity of fuel additionally added by the regeneration gas and thus the concentration in the regeneration gas.

In step 302, the tank venting valve 28 is controlled in such a way that a defined regeneration gas flow rate is set. The regeneration gas is thus introduced into the inlet manifold 9 of the internal combustion engine 1 and is used in the combustion.

Step 303 tests whether the internal combustion engine 1 is at a static operating point. The operating point can be considered as static if the speed of the internal combustion engine 1 and a load parameter, such as the quantity of fresh air supplied to the internal combustion engine, only change negligibly over a relatively long period of time. The query is repeated until a static operating point is detected.

Following a positive result for the query in step 303, step 304 detects the composition of the exhaust gas using the lambda sensor 17 and defines this as the reference composition.

In step 305, the tank venting valve is controlled such that the regeneration gas flow rate is varied by a pre-specified adjustment amount. The variation is understood to be both a reduction and an increase in the regeneration gas flow rate.

In step 306, a first injection quantity correction value is calculated according to equation 1 based on the adjustment amount of the regeneration gas flow rate and the fuel concentration in the regeneration gas determined in step 301.

In step 307, the quantity of fuel to be supplied via the injection valves is corrected by the calculated first injection quantity correction value.

Then, in step 308, the exhaust gas composition is determined again using the lambda sensor.

In step 309, a check is carried out to determine whether this exhaust gas composition is within a tolerance range around the reference composition of the exhaust gas determined in step 301. If this is the case, the value for the fuel concentration in the regeneration gas is assessed as plausible in step 310 and the method can either be ended or restarted from step 302.

If there is a negative result to the query in step 309, a second injection quantity correction value is calculated in step 311 according to equation 3 by which the corrected injection quantity must be corrected again, so that the reference composition of the exhaust gas is present again.

Then, in step 312, the value for the fuel concentration in the regeneration gas is corrected based on the first and second injection quantity correction values. This takes place in line with equations 2, 4 and 5.

The method can either be ended at this point or executed again starting from step 302. The method represented here offers the advantage that a correction of the value for the fuel concentration in the regeneration gas can be made with the tank venting valve 28 in any state of openness. It is no longer necessary to close the tank venting valve with subsequent slow opening in order to determine the concentration. This results in a considerably greater flexibility for the determination of the fuel concentration in the regeneration gas, so that a check for the accuracy of this value can be carried out significantly more frequently without limiting the tank venting processes too much. By determining the reference composition of the exhaust gas and carrying out the subsequent correction process at a static operating point of the internal combustion engine 1, other effects that influence the mixture composition, such as nonlinearities in the behavior of the injection valves, can be prevented from distorting the calculation of the fuel concentration in the regeneration gas. This can considerably increase the accuracy of the determination of the fuel concentration.

What is claimed:

1. A system for correcting the fuel concentration in a regeneration gas flow which is conducted from a fuel vapor canister of a tank venting device for an internal combustion engine, comprising:

means for determining the fuel concentration in the regeneration gas flow, means for setting a defined regeneration gas flow rate and for supplying the gas flow rate to the internal combustion engine such that the regeneration gas is used in the combustion, means for determining a reference composition of the exhaust gas of the internal combustion engine, means for varying the regeneration gas flow rate by a pre-specified adjustment amount, means for determining a first injection quantity correction value based on the fuel concentration in the regeneration gas flow and the adjustment amount of the regeneration gas flow rate, means for correcting a pre-specified fuel quantity, that is to be supplied to the internal combustion engine by at least one injection valve, by the first injection quantity correction value, means for re-determining the exhaust composition following the supply of the corrected fuel quantity, means for determining a second injection quantity correction value by which the corrected fuel quantity supplied by the at least one injection valve is to be further corrected in order to adjust the exhaust gas composition to the reference composition, and means for correcting the fuel concentration of the regeneration gas flow based on the first and the second injection quantity correction values.

2. The system according to claim 1, further comprising means for forming an estimated value based on variables that influence the charge state of the fuel vapor canister with fuel vapor in order to determine the fuel concentration in the regeneration gas flow.

3. The system according to claim 1, wherein the internal combustion engine is operated at a constant operating point from the time when the first reference composition is determined until at least the time when the exhaust gas composition of the internal combustion engine is determined again in order for the steps of the method to be carried out.

4. The system according to claim 1, wherein, in the event that the exhaust gas composition is within a pre-specified tolerance range around the reference exhaust gas composition after the corrected fuel quantity has been supplied, means for judging the value of the fuel concentration in the regeneration gas flow to be plausible and wherein no correction is carried out.

5. A control device for an internal combustion engine, which in order to correct the fuel concentration in a regeneration gas flow that is conducted out of a fuel vapor canister of a tank venting device for the internal combustion engine during a tank venting period, is operable to:

determine the fuel concentration in the regeneration gas flow, set a defined regeneration gas flow rate and to supply the gas flow rate to the internal combustion engine such that the regeneration gas is used in the combustion, determine a first reference composition of the exhaust gas of the internal combustion engine, vary the regeneration gas flow rate by a pre-specified adjustment amount, determine a first injection quantity correction value based on the fuel concentration in the regeneration gas flow and the adjustment amount of the regeneration gas flow rate, correct a pre-specified fuel quantity, that is to be supplied to the internal combustion engine by at least one injection valve, by the first injection quantity correction value, re-determine the exhaust composition following the supply of the corrected fuel quantity, determine a second injection quantity correction value by which the corrected fuel quantity supplied by the at least one injection valve is to be further corrected in order to adjust the exhaust gas composition to the reference composition, and to correct the fuel concentration of the regeneration gas flow based on the first and the second injection quantity correction values.

6. The device according to claim 5, wherein the device is further operable to form an estimated value based on variables that influence the charge state of the fuel vapor canister with fuel vapor in order to determine the fuel concentration in the regeneration gas flow.

7. The device according to claim 5, wherein the internal combustion engine is operated at a constant operating point from the time when the first reference composition is determined until at least the time when the exhaust gas composition of the internal combustion engine is determined again in order for the steps of the method to be carried out.

8. The device according to claim 5, wherein, in the event that the exhaust gas composition is within a pre-specified tolerance range around the reference exhaust gas composition after the corrected fuel quantity has been supplied, the value of the fuel concentration in the regeneration gas flow is judged to be plausible and no correction is carried out.

9. A method for correcting the fuel concentration in a regeneration gas flow which is conducted from a fuel vapor canister of a tank venting device for an internal combustion engine, comprising:

determining the fuel concentration in the regeneration gas flow, setting a defined regeneration gas flow rate and supplying the gas flow rate to the internal combustion engine such that the regeneration gas is used in the combustion, determining a reference composition of the exhaust gas of the internal combustion engine, varying the regeneration gas flow rate by a pre-specified adjustment amount, determining a first injection quantity correction value based on the fuel concentration in the regeneration gas flow and the adjustment amount of the regeneration gas flow rate, correcting a pre-specified fuel quantity, that is to be supplied to the internal combustion engine by at least one injection valve, by the first injection quantity correction value, re-determining the exhaust composition following the supply of the corrected fuel quantity, determining a second injection quantity correction value by which the corrected fuel quantity supplied by the at least one injection valve is to be further corrected in order to adjust the exhaust gas composition to the reference composition, and correcting the fuel concentration of the regeneration gas flow based on the first and the second injection quantity correction values.

10. The method according to claim 9, wherein an estimated value is formed based on variables that influence the charge state of the fuel vapor canister with fuel vapor in order to determine the fuel concentration in the regeneration gas flow.

11. The method according to claim 9, wherein the internal combustion engine is operated at a constant operating point from the time when the first reference composition is determined until at least the time when the exhaust gas composition of the internal combustion engine is determined again in order for the steps of the method to be carried out.

12. The method according to claim 9, wherein, in the event that the exhaust gas composition is within a pre-specified tolerance range around the reference exhaust gas composition after the corrected fuel quantity has been supplied, the value of the fuel concentration in the regeneration gas flow is judged to be plausible and no correction is carried out.

* * * * *